US011081301B2

(12) United States Patent
Gauthier et al.

(10) Patent No.: US 11,081,301 B2
(45) Date of Patent: Aug. 3, 2021

(54) ASSEMBLY COMPRISING A NORMALLY-OPEN ELECTRICAL SWITCH AND A CONTROL BLADE FOR CONTROLLING ITS CHANGE OF STATE WHICH KEEPS IT CLOSED AT REST

(71) Applicant: C&K COMPONENTS S.A.S., Dole (FR)

(72) Inventors: Philippe Gauthier, Liesle (FR); Jocelyn Mayot, Sampans (FR); Fabrice Valcher, Dole (FR); Laurent Kubat, Dole (FR)

(73) Assignee: C&K Components S.A.S., Dole (FR)

( * ) Notice: Subject to any disclaimer, the term of this patent is extended or adjusted under 35 U.S.C. 154(b) by 0 days.

(21) Appl. No.: 16/944,361

(22) Filed: Jul. 31, 2020

(65) Prior Publication Data

US 2021/0035755 A1 Feb. 4, 2021

(30) Foreign Application Priority Data

Aug. 1, 2019 (FR) ..... 1908812

(51) Int. Cl.
*H01H 35/02* (2006.01)
*H01H 3/20* (2006.01)
*H01H 9/28* (2006.01)

(52) U.S. Cl.
CPC ..... *H01H 35/02* (2013.01); *H01H 3/20* (2013.01); *H01H 9/287* (2013.01)

(58) Field of Classification Search
CPC ..... H01H 35/02; H01H 3/20; H01H 9/287; H01H 3/02; H01H 5/04; H01H 5/30
USPC .. 200/61.52, 329, 330, 17 R, 406, 408, 529, 200/339, 553, 557, 343
See application file for complete search history.

(56) References Cited

U.S. PATENT DOCUMENTS 8,440,927 B2 * 5/2013 Lin ..... H01H 13/36 200/408
2002/0100676 A1 * 8/2002 Janniere ..... H01H 13/48 200/406
2005/0224330 A1 * 10/2005 Liu ..... H01H 13/48 200/345
2006/0037851 A1 * 2/2006 Hu ..... H01H 15/102 200/406

(Continued)

FOREIGN PATENT DOCUMENTS

FR 1398769 A 5/1965
FR 2720865 A1 12/1995
GB 2535977 A 9/2016

*Primary Examiner* — Edwin A. Leon
*Assistant Examiner* — Iman Malakooti
(74) *Attorney, Agent, or Firm* — Fox Rothschild LLP

(57) ABSTRACT

An assembly includes an electrical switch and an elastically deformable control blade for controlling change of state of its trip member. The control blade comprises: (i) a fixing branch; (ii) an actuation branch which, in the absence of application of an actuation effort, stresses the trip member in the direction of closure of the electrical switch, and (iii) a control branch which can pivot about an axis to provoke tilting of the actuation branch against its elasticity to keep the electrical switch in an open free state. The assembly may include a locking device for locking the control blade in an initial position of delivery of the assembly. The unlocking of the control blade may be provoked automatically upon a first application of an actuation effort on the control blade.

14 Claims, 6 Drawing Sheets

(56) References Cited

U.S. PATENT DOCUMENTS

| | | | | |
|---|---|---|---|---|
| 2007/0039811 | A1* | 2/2007 | Yanai | H01H 13/64<br>200/406 |
| 2015/0041296 | A1* | 2/2015 | Bertsch | G06K 7/00<br>200/329 |

* cited by examiner

ASSEMBLY COMPRISING A NORMALLY-OPEN ELECTRICAL SWITCH AND A CONTROL BLADE FOR CONTROLLING ITS CHANGE OF STATE WHICH KEEPS IT CLOSED AT REST

RELATED APPLICATIONS AND CLAIM OF PRIORITY

This patent document claims priority under 35 U.S.C. § 119(1) to France Patent Application Number 1908812, filed Aug. 1, 2019.

TECHNICAL FIELD

The invention relates to an assembly comprising an electrical switch of the normally-open type.

BACKGROUND

Various electrical switches of the normally-open type are known. One such device comprises a trip member and an associated, elastically deformable blade for controlling the change of state of the electrical switch in response to the application of an actuation effort on the control blade, in which, in the absence of application of an actuation effort, the electrical switch is kept in a closed state.

Such an assembly is known from the document FR-A1-2.720.865 in which, according to the first embodiment which is described therein and as therein illustrated in FIGS. 1 and 2 (with reference numbers here being those contained in that document), it comprises: an electrical switch comprising a trip member 26; and an elastically deformable blade 32 for controlling the change of state of the electrical switch in response to the application of an actuation effort on the control blade. The switch also includes an assembly in which the control blade comprises a branch 36 for fixing the control blade with respect to the trip member 26; an actuation branch 40, a rear end of which is linked to the fixing branch 36 and which, in the absence of application of an actuation effort, stresses the trip member 26 of the electrical switch in a direction corresponding to the closure of the switch; and a control branch 34 which is linked to the actuation branch 40 and which, under the application of an actuation effort which is applied to it by an actuation member 10, pivots (about an axis X-X orthogonal to the direction of actuation of the trip member 26) to provoke a tilting of the actuation branch 40 against its elasticity to keep the electrical switch in an open free state.

When a switch of the normally open type is stored and kept under effort for a period of time, the first use of a device containing such a switch may cause the switch to trip with relatively little effort. The invention described below aims to provide a solution to this problem.

SUMMARY

The invention proposes an assembly comprising an electrical switch comprising a trip member, the changes of state of which provoke a change of state of the electrical switch between an open free state and a closed actuated state. The electrical switch also comprises an elastically deformable blade for controlling the change of state of the electrical switch in response to the application of an actuation effort on the control blade.

The control blade comprises: (i) a fixing branch for fixing the control blade with respect to the trip member; (ii) an actuation branch, a rear end of which is linked to the fixing branch and which, in the absence of application of an actuation effort, stresses the trip member of the electrical switch in a direction corresponding to the closure of the electrical switch; and (iii) a control branch which is linked to the actuation branch and which, when under the application of an actuation effort which is applied to it by an actuation member, will pivot about an axis orthogonal to the direction of actuation of the trip member to provoke a tilting of the actuation branch against its elasticity to keep the electrical switch in an open free state.

The assembly also comprises a locking device for locking the control blade in an initial position of delivery of the assembly in which the actuation branch does not stress the trip member of the electrical switch which is in its open state.

In some embodiments, the unlocking of the control blade may be provoked upon a first application of an actuation effort on the control blade. In addition, the locking device may lock the control branch of the control blade in an initial angular position of delivery of the assembly in which the actuation branch does not stress the trip member of the electrical switch which is in its open state, and the unlocking of the control branch may be provoked upon a first application of an actuation effort on the control branch. Optionally, the control branch may extends in a longitudinal direction from a front end of the actuation branch; and the locking device locks an opposite free end of the control branch In some embodiments, the locking device comprises a retractable locking tongue which comprises a hole (forming a strike) in which said free end of the control branch (forming a bolt) is received when the control branch is in its initial angular position of delivery, Also, the locking tongue may comprise a latch controlling the unlocking thereof on which the actuation member acts upon a first application of an actuation effort to release said free end. The locking tongue may be formed produced in a single piece with the control blade. The control branch may extend longitudinally from front to rear above the actuation branch. The control branch may be a rigid branch forming a lever controlling the tilting of the actuation branch.

In some embodiments, the electrical switch comprises a housing which houses the trip member and which can be fixed onto a support, for example onto a printed circuit board.

In some embodiments, the fixing branch of the control blade may be fixed to the housing of the electrical switch, and/or it may be fixed onto the printed circuit board;

In some embodiments, the electrical switch comprises a pushbutton for actuating the trip member. The electrical switch also may include an elastic return member, distinct from the trip member, for returning the trip member to a position of rest in which the electrical switch is in its open free state.

The invention also proposes an arrangement of an assembly according to the invention for actuating the electrical switch, characterized in that it comprises an actuation member which is movable with respect to the control branch, in succession between: a position of rest; an intermediate position in which it cooperates with the locking device to, if necessary, provoke the unlocking of the control blade; and an active position in which the control blade keeps the electrical switch in its open state.

BRIEF DESCRIPTION OF THE FIGURES

Other features and advantages of the invention will become apparent on reading the following detailed description, for an understanding of which reference will be made to the attached drawings in which.

DETAILED DESCRIPTION

Figure 1:
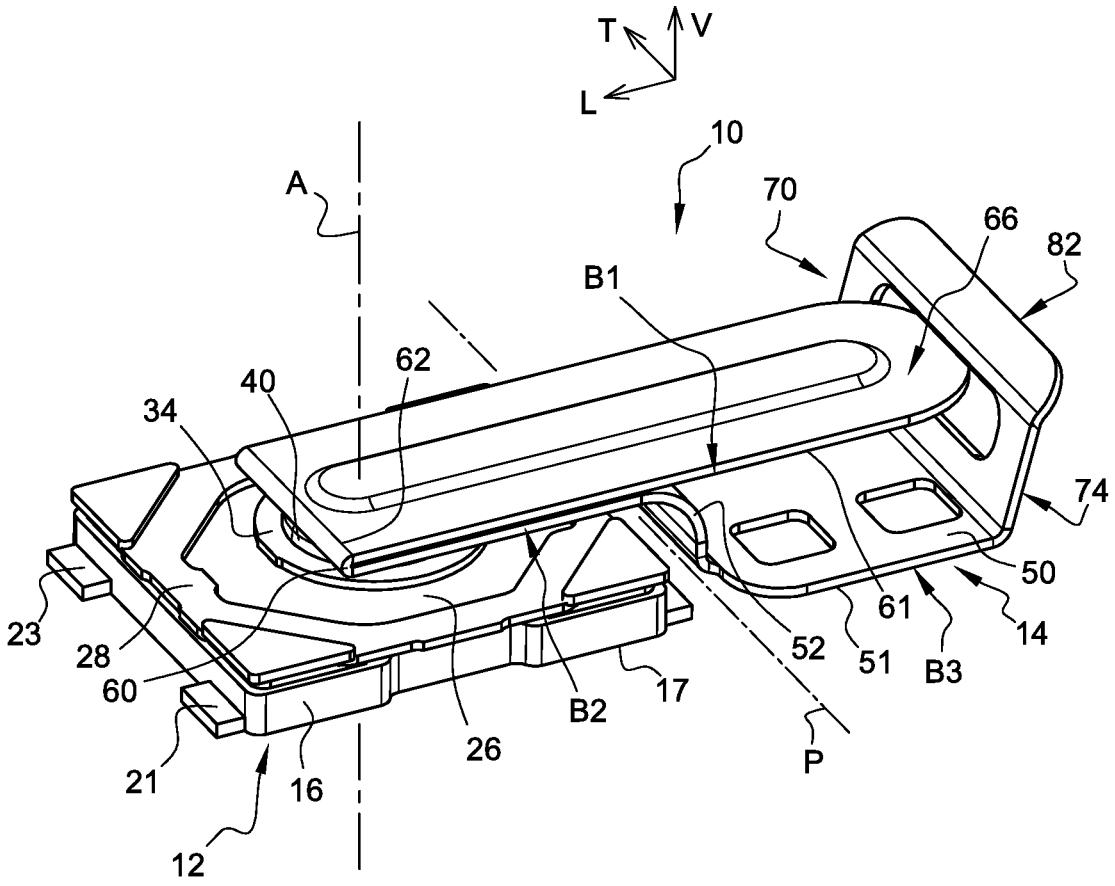
FIG. 1 is a perspective view of an example embodiment according to the invention which is illustrated in an initial, so-called "locked" state of the control branch of the control blade.
Figure 2:
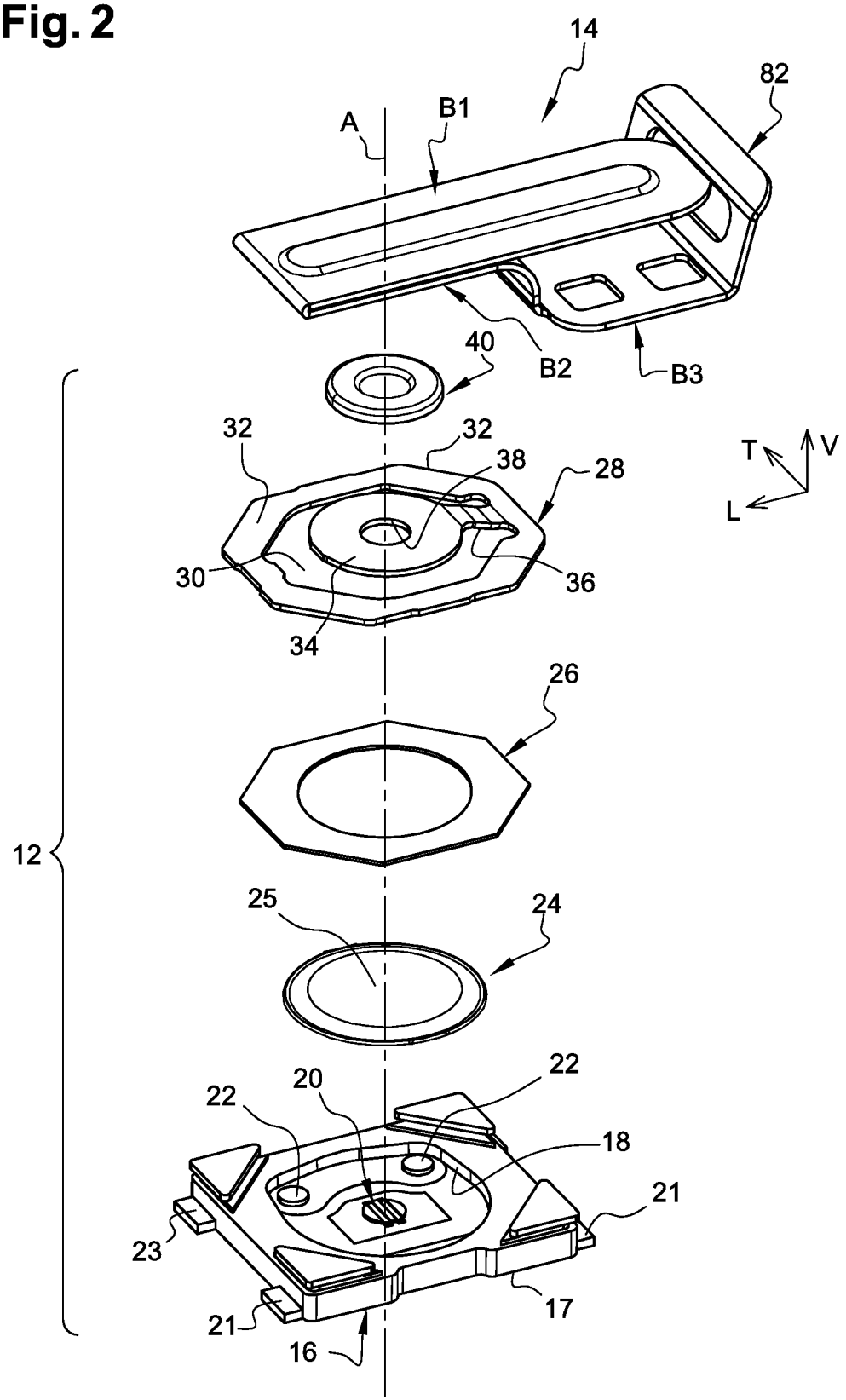
FIG. 2 is an exploded perspective view of the main components of the assembly illustrated in FIG. 1.
Figure 3:
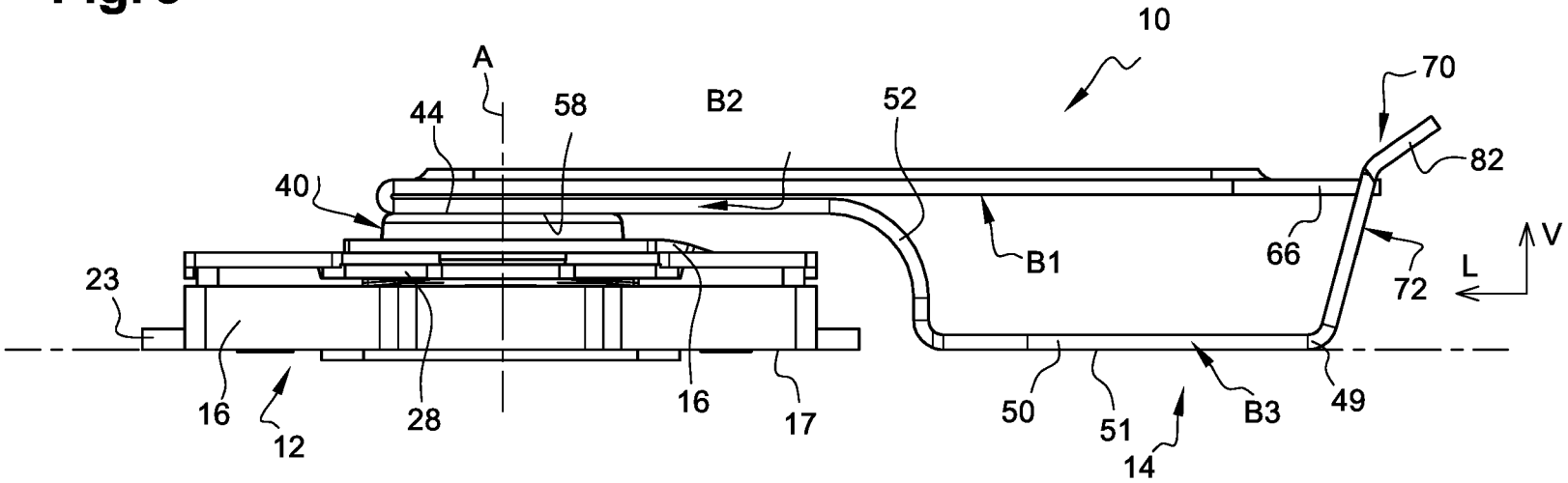
FIG. 3 is a side view of the assembly illustrated in FIG. 1.

For the description of the invention and the understanding of the claims, the vertical, longitudinal and transverse orientation will be adopted without limitation and without limiting reference to the Earth's gravity, according to the V, L, T reference frame illustrated in the figures, the longitudinal L and transverse T axes of which extend in a horizontal plane.

By convention, the longitudinal axis L is oriented from back to front, here from right to left looking at the figures.

In the following description, the elements that are identical, similar or alike will be designated by the same reference numerals.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

In the following description, the assembly exhibits a general symmetry of design with respect to the vertical and median longitudinal plane PVL.

An electrical switch of a normally open type may be incorporated in a device for reading and writing data contained in an electronic memory card and, in the absence of a card in read position acting on the control branch, the electrical switch, and particularly its trip member, is kept under effort by the actuation branch.

This is especially the case when, after the manufacture of the assembly and its integration in an electronic or electromechanical unit—and before the first use or functional startup of the unit—the latter is stored for a period that can be very long, until the delivery thereof and the first use provoking at least one first change of state of the electrical switch for the latter to at least temporarily revert to its open free state without effort, or almost without effort on its trip member.

The inventors' solution to this problem is described below.

FIGS. 1 to 7 show a locked state of a control branch and electrical switch in its open free state.

The present invention relates to an assembly 10 essentially comprising an electrical switch 12 and a control blade 14 for indirect actuation of the electrical switch 12.

According to the design illustrated in the figures, the electrical switch 12 is of the so-called normally-open type (NO type), that is to say an electrical switch in which, in the absence of a sufficient actuation effort applied to the electrical switch, the switching way is interrupted or open while, in response to the application of a sufficient actuation effort, the electrical switch 12 is closed and the switching way is established.

The electrical switch 12 essentially comprises a bottom housing 16 made of insulating material, here of square parallelepipedal form, which delimits an internal housing 18 in the bottom of which there are arranged at least two, central 20 and peripheral 22 electrical fixed contacts, each of which is electrically linked to an associated electrical connection terminal 21, 23 arranged outside the housing 16.

As is known, a trip member 24 made of conductive material is housed in the internal housing 18 and it is, here, produced in the form of a dome of spherical cap form of circular outline, the convexity of which is oriented vertically upwards.

Figure 4:
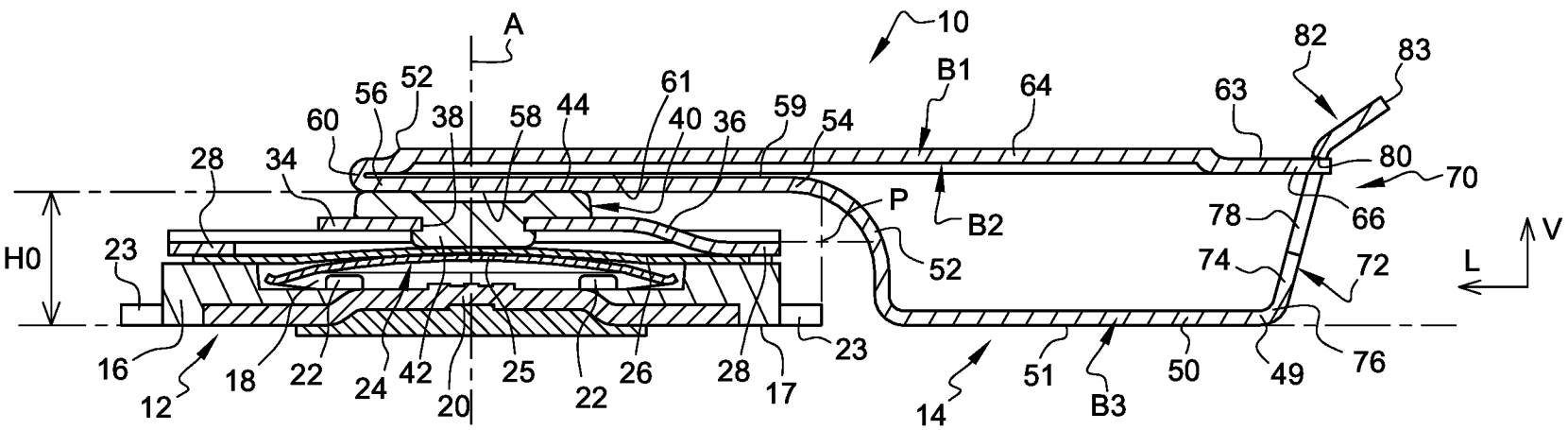
FIG. 4 is a cross-sectional view, through a vertical and median longitudinal plane, of the assembly illustrated in FIG. 1.
Figure 5:
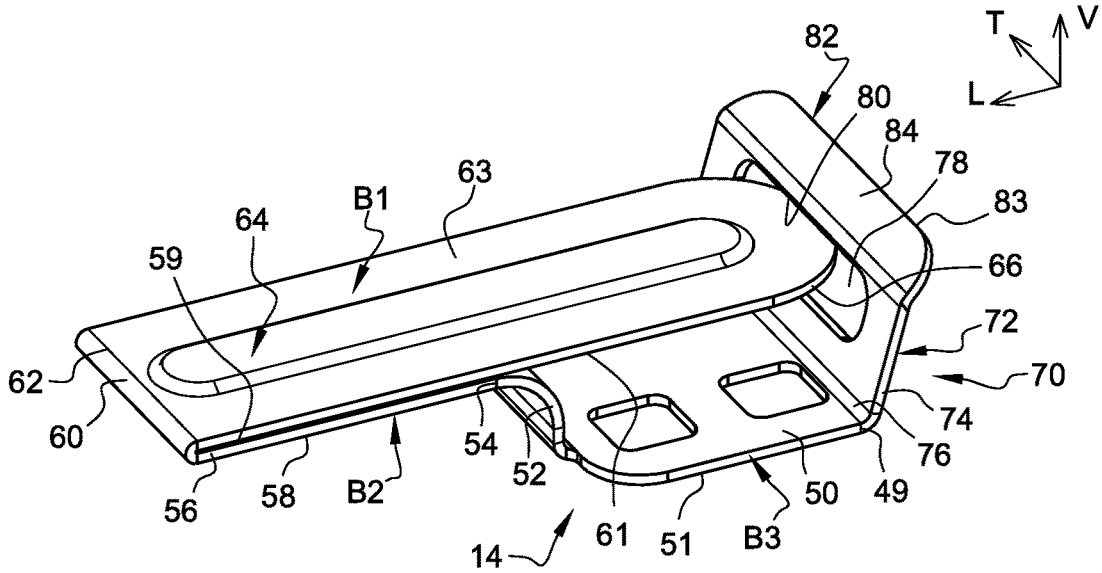
FIG. 5 is a larger scale perspective view of the control blade illustrated in FIG. 1.
Figure 6:
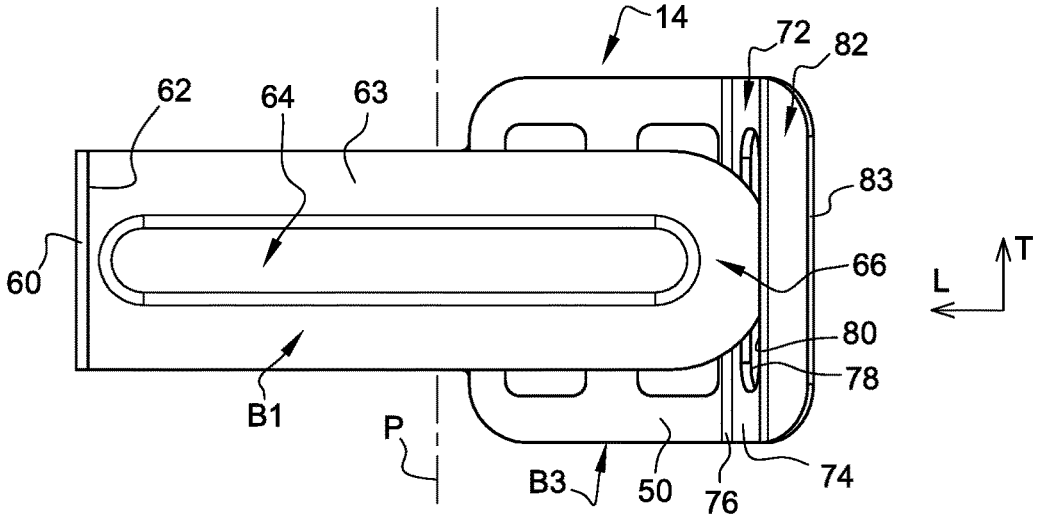
FIG. 6 is a larger scale plan view of the control blade illustrated in FIG. 1.

In its state of rest illustrated in FIG. 4, the top 25 of the trip member 24 is situated vertically above the central fixed contact 20 and no switching way is established between the two fixed contacts 20 and 22.

When an actuation effort of sufficient value is applied to the top 25 of the trip member 24 along the vertically oriented actuation axis A, the trip member 24 changes state and is deformed to, as is known, establish an electrical switching way between the two fixed contacts 20 and 22 and therefore between the connection terminals 21 and 23.

The housing 16, with its connection terminals 21 and 23, is here designed so as to be able to be fixed onto the top face of a printed circuit board (not represented), for example based on the so-called CMS technique.

The electrical switch 12 here comprises an adhesive sealing film 26 which tightly closes the internal housing 18 with the trip member 24 arranged inside.

For the actuation of the electrical switch 12 and of the trip member 24, the electrical switch 12 here comprises, as a nonlimiting example, a top plate or cage of annular outline 28 which is, for example, fixed to the bottom housing 16 by crimping the body thereof around the corner portions 32 of the top plate 28.

Figure 9:
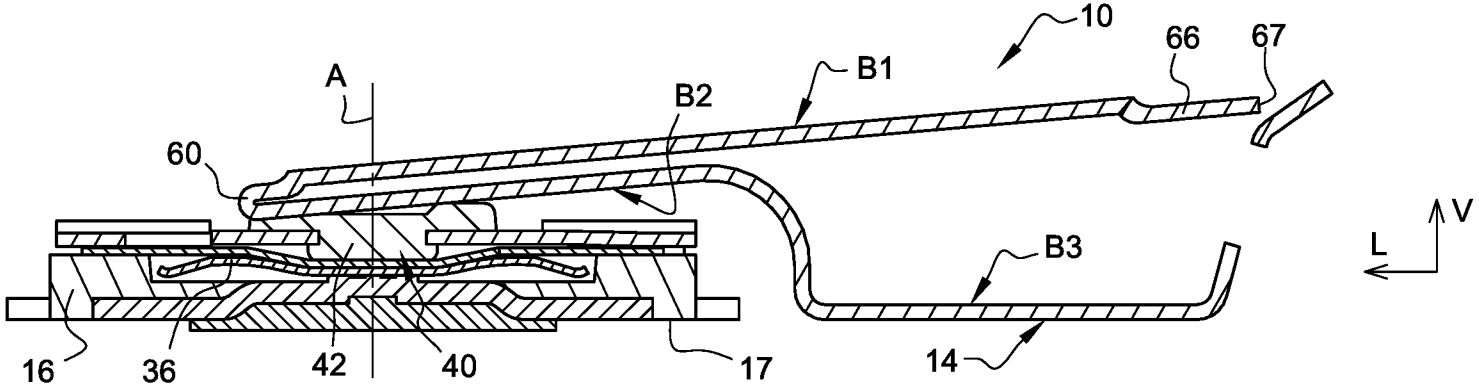
FIG. 9 is a cross-sectional view, through a vertical and median longitudinal plane, of the assembly illustrated in FIG. 8.

In its central part 30, the top plate 28 comprises a central ring 34 which is linked to it by an elastically deformable link tab 36 in such a way that the latter can be displaced vertically downwards from its top position of rest, illustrated in FIG. 4, to a bottom actuation position illustrated in FIG. 9, and this is done against the elastic return effort returning it to its top position of rest which is applied to the central ring 34 by the link tab 36.

The top plate 28 with its central ring 34 is, here, produced in a single metal piece by cutting and bending.

The central orifice 38 of the central ring 34 houses an actuation pushbutton 40, the bottom end 42 of which cooperates with a portion facing the outer top face of the central part or top of the trip member 24.

The pushbutton 40 is, for example, produced by overmoulding on the central ring 34.

The free top face 44 of the pushbutton 40 is, here, of flat and horizontal annular form.

In the top position of rest of the pushbutton 40, its free top face 44 is situated at a height "H0" from the plane of the horizontal bottom face 17 of the housing 16 (see FIG. 4).

The control blade 14 is an elastically deformable part produced here from a cut and folded metal sheet.

The control blade 14 extends overall in a longitudinal direction with a rear fixing bottom part, a front functional top part and a rear locking part.

More specifically and in a nonlimiting manner, the control blade 14 here comprises a flat, top control branch B1, an adjacent flat top actuation branch B2 and a flat and horizontal bottom fixing branch B3.

The bottom fixing branch B3 comprises a flat and horizontal main fixing section 50 which extends longitudinally from back to front and which is extended, forwards and upwards, by a section 52 bent at 90 degrees for connection and "articulation".

The main fixing section 50 is for example designed for the control blade 14 to be fixed onto the top face of the printed circuit board to which the housing 16 of the electrical switch 12 is soldered, thus with the bottom face 51 of the main fixing section 50 in the same plane as that of the bottom face 17 of the housing 16.

From the front top end 54 of the connection section 52, the fixing branch B3 is extended by the actuation branch B2.

The actuation branch B2 is a continuous flat branch which extends longitudinally from back to front from the end 54 to a front end 56.

In the locked state illustrated in FIGS. 1 to 7, the actuation branch B2 extends substantially horizontally parallel to the main fixing section 50 and, in the vicinity of its front end 56, the bottom face 58 of the actuation branch B2 bears flat without play on the annular top face 44 of the pushbutton 40.

However, in this locked state, the actuation branch B1 does not exert an actuation effort on the trip member 24 and the electrical switch 12 is kept in its open free state.

The top control branch B1 is a continuous flat branch which extends longitudinally from front to back from a front end 62.

The top control branch B1 comprises a top longitudinal reinforcing rib 64 which gives it great rigidity and makes it almost undeformable with respect to the efforts which are applied to it.

The front end 62 of the control branch B1 is, here, linked to the front end 56 of the actuation branch B2 by a 180-degree bend 60.

The control branch B1 is thus "folded" above the actuation branch B2 with its bottom face 61 adjacent to the top face 59 of the actuation branch B2.

The top face 63 of the control branch B1 which surrounds the central rib 64 is flat.

The control branch B1 ends with a rear free end section 66, here of semi-circular outline.

In the locked state illustrated in FIGS. 1 to 7, the control branch B1 extends substantially horizontally parallel to the actuation branch B2 and to the main fixing section 50.

The control branch B1, and particularly its free rear end section 66, extends longitudinally backwards above the fixing branch B3, and particularly beyond the rear end 49 of the main fixing section 50.

The invention is not limited to the embodiment described according to which the control B1, actuation B2 and fixing B3 branches are overall superposed. As a variant that is not represented, the control and actuation branches can extend in the longitudinal extension of one another and the fixing branch can be produced in the form of two opposing lateral branches situated on either side of the control branch.

The assembly 10 comprises means for locking the control branch B1 and the actuation branch B2 in the locked state illustrated in FIGS. 1 to 7 which show a device 70 for locking the control blade 14. As a non-limiting example, the locking means may be produced in a single piece with the control blade 14.

To this end, beyond its rear longitudinal end 49, the main horizontal fixing section 50 of the fixing branch B3 is extended by a locking tongue 72 which extends overall upward by being here slightly inclined backwards relative to the vertical.

The locking tongue 72 is a tongue that can be retracted by elastic deformation.

The main section 74 of the locking tongue 72 is in the form of a flat plate which is linked to the end 49 by a connection and "articulation" bend 76.

In its central part, the main section 74 of the locking tongue 72 comprises a central hole 78 of transverse orientation which is for example delimited by a transverse and horizontal top edge 80.

The central hole 78 constitutes the strike of the locking device 70 and the free rear end section 66 of the control branch B1 constitutes the associated bolt thereof.

Thus, in the locked position illustrated in FIGS. 1 to 7, the free end section 66 is received in the hole 78 and it is elastically stressed upwards so that its top face bears elastically against the top edge 80.

Thus, the locking device determines the position and the orientation occupied by the control branch B1 and the actuation branch B2, with respect to the electrical switch.

In order to be able to unlock the control branch B1 and thus release the control blade 14 for it to be used to control changes of state of the electrical switch 12, the locking tongue 74 comprises an unlocking control latch 82 which is arranged at the top end of the main section 74.

The control latch 82 is delimited by a free top edge 83 and it is inclined backwards so as to have a top face 84 that is inclined at approximately 45 degrees relative to the vertical.

In the locked position, the control latch 82 and its top edge 83 extend vertically above the horizontal plane corresponding to the top face 63 of the control branch B1.

The main section 74 and the control latch 82 form an overall rigid tongue which can pivot about a transverse horizontal axis corresponding substantially to the bend 49, in response to an unlocking control effort applied to the control latch 82, and here to the top edge 83 and/or to the top face 84.

Through its elasticity, the locking tongue is returned to its rest and locking position illustrated in FIGS. 1 to 7.

The unlocking is controlled by acting on the control latch 82, by pivoting the locking tongue in the clockwise direction about the bend 49, at least until the free end section 66 of the control branch B1 is made to escape from the central hole 78.

Figure 8:
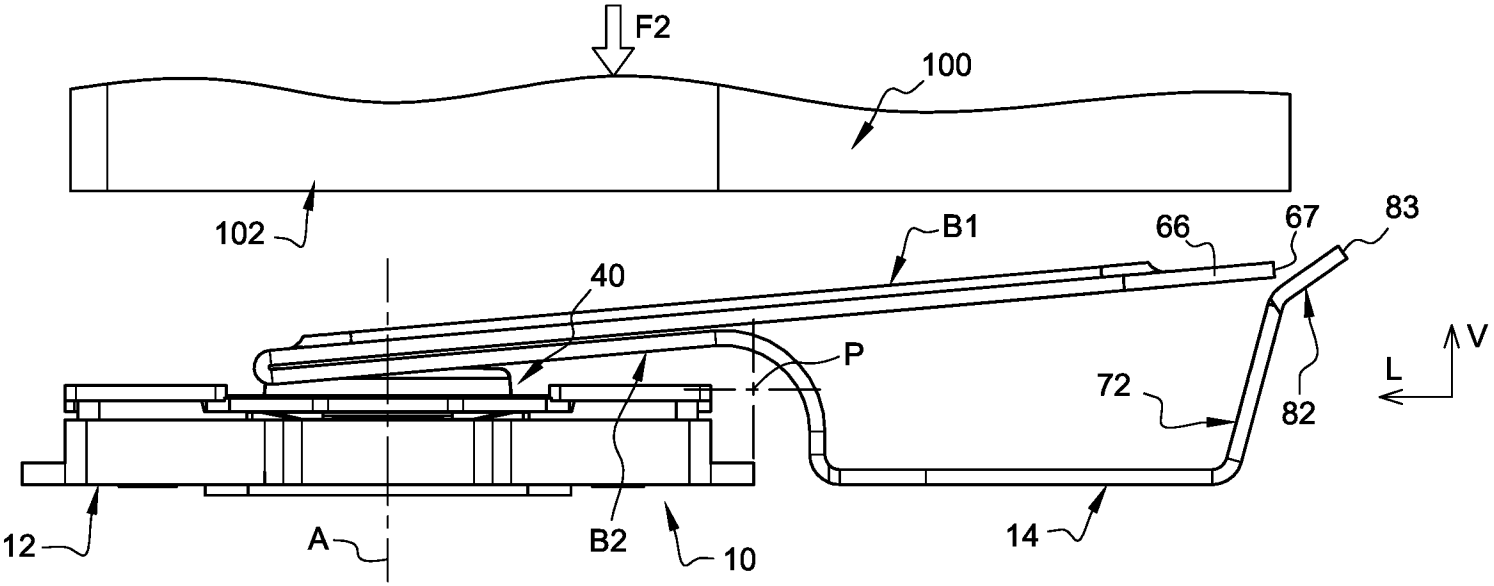
FIG. 8 is a view similar to that of FIG. 3 in which the assembly is illustrated in a so-called "relaxed" state of the control branch of the control blade, after unlocking of the control branch, and which is represented in association with the actuation member in position of rest.

When the unlocking effort ceases to be applied to the control latch 82, and therefore to the locking tongue 72, the locking tongue 72 reverts to its initial rest and locking position, but the control branch B1, and thus the control blade 14, remains in an unlocked and released state (see FIGS. 8 and 9).

As a variant that is not represented, the change of angular position of the locking tongue 72 from its initial rest and locking position or state can be obtained by a plastic deformation at the connection bend 49.

As is illustrated schematically in FIG. 7, to act on the control latch 82 and therefore on the locking tongue 72, and subsequently on the "unlocked" control branch B1, it is proposed to act on the assembly 10 by means of a single actuation member 100.

As a non-limiting example and in the example illustrated in FIGS. 7, 8, 10 and 11, the actuation member 100 can be displaced vertically in both directions relative to the assembly 10 and it is delimited by a flat horizontal bottom face 102.

The actuation member 100 can thus apply a first effort "F1" vertically downwards to the assembly 10.

Figure 7:
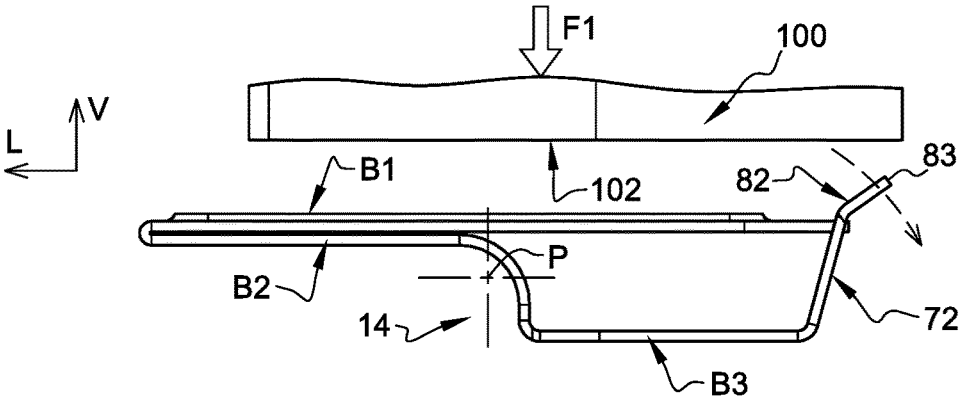
FIG. 7 is a larger scale side view of the control blade illustrated in the preceding figures which is represented in association with an actuation member in position of rest.

As can be understood by considering FIG. 7, a first travel of actuation of the actuation member 100 downwards will result in the cooperation of a portion of the bottom face 102 with the control latch 82 to provoke the pivoting of the locking tongue 74 and the unlocking of the control branch B1 (see FIG. 7).

If the effort F1 is relaxed, the control branch occupies its unlocked and relaxed state which will now be described with reference to FIGS. 8 and 9.

When the control blade 14 is in its unlocked and relaxed state illustrated in FIGS. 8 and 9, because of its own elasticity and the elastic return effect exerted particularly by the connection bend 52 the adjacent control B1 and actuation B2 branches occupy the angular position illustrated which corresponds to a tilting or pivoting, in the anticlockwise direction, about the pivoting axis P, relative to the locked state illustrated in FIGS. 1 to 7.

Thus, the free edge 67 of the free end section 66 of the control branch B1 is situated vertically above the plane in which is situated the free top edge 83 of the unlocking control latch 82.

Because of its tilting and of the elastic effort to which it is subjected, in its state in FIGS. 8 and 9, the actuation branch B2 is inclined relative to the main fixing section 50 and, in the vicinity of its front end 56, the bottom face 58 of the actuation branch B2 bears without play on the annular top face 44 of the pushbutton 40.

Via the actuation branch B2, the control blade 14 thus permanently exerts an actuation effort on the pushbutton 40 and through the latter on the trip member 24 which provokes the change of state thereof, and therefore of the electrical switch 12 which is then kept in a closed state in which the electrical switching way between the connection terminals 21 and 23 is established.

From this state or position, if, as is illustrated schematically in FIG. 8, a new actuation effort F2 is applied by means of the actuation member 100, a portion of the bottom face 102 thereof will cooperate with the free rear end edge 67 then with the top face of the control branch B1.

Thus, against the elastic return effort applied by the bend 52 to the adjacent control B1 and actuation B2 branches, the actuation member 100 continues its course until the open state of the electrical switch 12 is reached, which will be described with reference to FIGS. 10 and 11.

Figure 10:
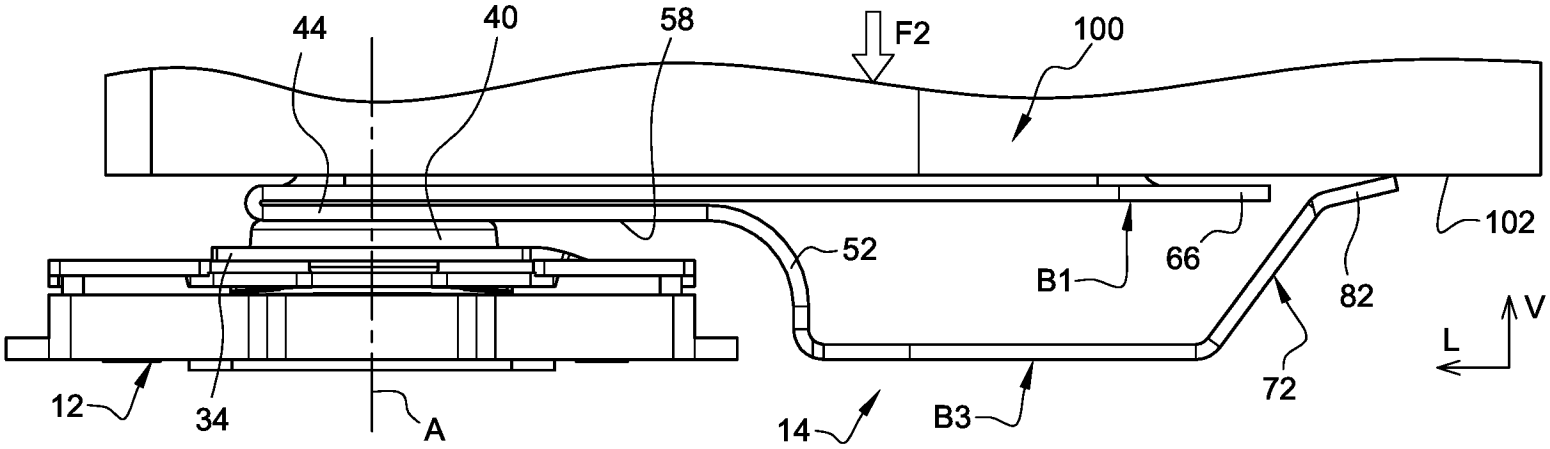
FIG. 10 is a view similar to that of FIG. 8 in which the assembly is illustrated in a so-called "actuated" state of the control branch of the control blade, under the effect of the actuation effort which is applied to it by the actuation member in active position in which the control blade keeps the electrical switch in its open state.
Figure 11:
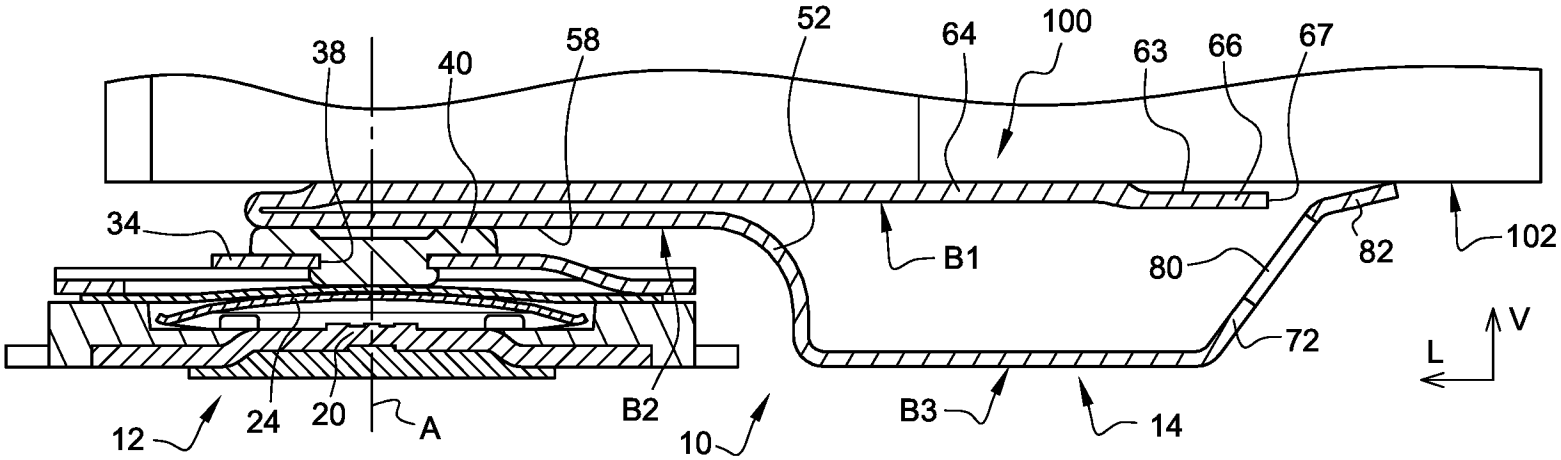
FIG. 11 is a cross-sectional view, through a vertical and median longitudinal plane, of the assembly illustrated in FIG. 10.

This actuated state illustrated in FIGS. 10 and 11—in which the electrical switch 12 is open—is maintained for as long as long as an actuation effort F2 of sufficient value is applied to the control branch B1.

If the actuation effort is relaxed, the control branch B1 once again occupies its unlocked and relaxed state illustrated in FIGS. 8 and 9.

Moreover, considering FIGS. 8 to 10, the geometrical and dimensional arrangement of the unlocking tongue 72 relative to the control branch B1 is such that the actuation travel of the actuation member 100 also provokes an action on the unlocking tongue 74 in the unlocking direction, thus eliminating any risk of accidental "relocking" of the control branch B1 when the actuation effort is relaxed.

FIGS. 10 and 11 illustrate an actuated state of the control branch and electrical switch in its open free state. When the actuation member 100 is in its bottom active position illustrated in FIGS. 10 and 11, the control B1 and actuation B2 branches are once again in the angular position that they occupied initially (before they were unlocked) in which they are horizontal and they no longer act on the pushbutton 40.

In this state, the actuation branch B2 extends horizontally parallel to the main fixing section 50 and, in the vicinity of its front end 56, the bottom face 58 of the actuation branch B2 bears flat without play on the annular top face 44 of the pushbutton 40.

The actuation branch B1 does not exert an actuation effort on the trip member 24 and the electrical switch 12 is kept in its open free state.

A change of state of the electrical switch 12 has thus been provoked from its closed state (FIG. 9) to its open free state (FIG. 11).

When the application of the actuation effort is interrupted, the control blade 14, and particularly the control B1 and actuation B2 branches revert to the state illustrated in FIGS. 8 and 9 by provoking a new change of state of the electrical switch 12 from its open state (FIG. 11) to its closed state (FIG. 9).

As a variant, an actuation member can act and successively exert an effort on the control latch, then actuation efforts on the control branch B1 in another direction of actuation, and for example in the horizontal direction.

When the change of angular position of the locking tongue 72 from its initial rest and locking position or state is obtained by an elastic deformation at the connection bend 49 and the locking tab automatically reverts to its initial position of rest, the design according to the invention advantageously makes it possible to implement a method for testing the assembly and the electrical switch, particularly after it has for example been soldered onto the top face of a printed circuit board.

The aim of this test is to check the quality of the fixing, of the electrical connections and the correct operation of the electrical switch, and particularly its changes of closed or open states.

The test procedure also allows the final customer who has incorporated the assembly in a device or unit to be controlled by means of the assembly, to test the correct operation thereof, then to once again lock the control blade.

This method for testing the assembly and the switch includes (with reference numbers from FIGS. 1-7): (a) manufacturing an assembly 10 that includes a switch and control blade as described above; (b) fixing such an assembly 10 onto a top face of a subassembly, for example onto the top face of a printed circuit board, in a state in which the control blade 14 is in its initial position of delivery; (c) acting on the control blade 14 by applying to it an actuation effort to provoke the unlocking of the control blade 14 and provoke a change of state of the electrical switch 12; (d) performing operations to test the correct operation of the assembly 10, of the electrical switch 12, and/or of a unit (not represented) equipped with the assembly 10 to control at least one function thereof; an (e) proceeding once again to lock the control blade 14 in its initial position of delivery of the assembly 10.

The invention claimed is:

1. An assembly comprising:

an electrical switch comprising a trip member; and an elastically deformable control blade for controlling the change of state of the electrical switch in response to the application of an actuation effort on the control blade, and in which the control blade comprises:

a fixing branch for fixing the control blade with respect to the trip member, an actuation branch, a rear end of which is linked to the fixing branch and which, in the absence of application of an actuation effort, stresses the trip member in a direction corresponding to the closure of the electrical switch, and a control branch which is linked to the actuation branch and which, when under application of an actuation effort which is applied to it by an actuation member, will pivot about an axis orthogonal to a direction of actuation of the trip member to provoke a tilting of the actuation branch against its elasticity to keep the electrical switch in an open free state; and a locking device for locking the control blade in an initial position of delivery of the assembly in which the actuation branch does not stress the trip member of the electrical switch which is in its open state.

2. An assembly according to claim 1, wherein the control blade is configured to be provoked to unlock upon a first application of an actuation effort on the control blade.

3. An assembly according to claim 2, wherein:

the locking device is configured to lock the control branch of the control blade in an initial angular position of delivery of the assembly in which the actuation branch does not stress the trip member of the electrical switch which is in its open state; and the unlocking of the control branch is provoked upon a first application of an actuation effort on the control branch.

4. An assembly according to claim 3, wherein:

the control branch extends from a front end of the actuation branch; and the locking device locks a free end of the control branch, wherein the free end is opposite the front end.

5. An assembly according to claim 4, wherein:

the locking device comprises a retractable locking tongue which comprises a hole in which said free end of the control branch is received when the control branch is in its initial angular position of delivery; and the locking tongue comprises a latch for controlling unlocking thereof on which the actuation member is configured to act upon a first application of an actuation effort to release said free end.

6. An assembly according to claim 5, wherein the locking tongue is formed in a single piece with the control blade.

7. An assembly according to claim 4, wherein the control branch extends longitudinally from front to rear above the actuation branch.

8. An assembly according to claim 7, wherein the control branch is a rigid branch forming a lever controlling the switch over of the actuation branch.

9. An assembly according to claim 1, wherein the electrical switch further comprises a housing which houses the trip member.

10. An assembly according to claim 1, wherein the housing is fixed on to a printed circuit board that provides a support for the housing.

11. An assembly according to claim 10, wherein the fixing branch of the control blade is fixed to the housing of the electrical switch or to the printed circuit board.

12. An assembly according to claim 1, wherein the electrical switch further comprises:

a pushbutton for actuating the trip member; and an elastic return member, distinct from the trip member, for returning the trip member to a position of rest in which the electrical switch is in its open free state.

13. An assembly according to claim 1, further comprising an actuation member which is movable with respect to the control branch between:

a position of rest;

an intermediate position in which it cooperates with the locking device to provoke unlocking of the control blade; and an active position in which the control blade keeps the electrical switch in its open state.

14. A method for testing an assembly that comprises an electrical switch, the method comprising:

providing an assembly that comprises:

an electrical switch comprising a trip member, and an elastically deformable control blade for controlling the change of state of the electrical switch in response to the application of an actuation effort on the control blade, and in which the control blade comprises:

a fixing branch for fixing the control blade with respect to the trip member;

an actuation branch, a rear end of which is linked to the fixing branch and which, in the absence of application of an actuation effort, stresses the trip member in a direction corresponding to the closure of the electrical switch; and a control branch which is linked to the actuation branch and which, when under application of an actuation effort which is applied to it by an actuation member, will pivot about an axis orthogonal to a direction of actuation of the trip member to provoke a tilting of the actuation branch against its elasticity to keep the electrical switch in an open free state and a locking device for locking the control blade in an initial position of delivery of the assembly in which the actuation branch does not stress the trip member of the electrical switch which is in its open state.

fixing the assembly onto a top face of a subassembly, in a state in which the control blade is in an initial position of delivery;

acting on the control blade by applying to it an actuation effort to provoke unlocking of the control blade and provoke a change of state of the electrical switch;

performing operations to test operation of the assembly, the electrical switch, a unit equipped with the assembly to control at least one function thereof, or a combination of any; and proceeding to lock the control blade in its initial position of delivery.

* * * * *